US006085618A

United States Patent [19]

Macor

[11] Patent Number: 6,085,618

[45] Date of Patent: Jul. 11, 2000

[54] WRENCH SOCKET LEVER

[75] Inventor: Richard J. Macor, Warren County, N.J.

[73] Assignee: Proprietary Technologies, Inc.

[21] Appl. No.: 09/124,786

[22] Filed: Jul. 30, 1998

Related U.S. Application Data

[63] Continuation-in-part of application No. 29/061,533, Oct. 25, 1996, Pat. No. Des. 396,785.

[51] Int. Cl.[7] ..... B25B 13/16

[52] U.S. Cl. ..... 81/177.85

[58] Field of Search ..... 81/62, 177.8, 177.85

[56] References Cited

U.S. PATENT DOCUMENTS

| | | | |
|---|---|---|---|
| 1,822,428 | 9/1931 | Zilliox | 81/177.8 |
| 5,396,820 | 3/1995 | Baker | 81/177.85 |
| 5,477,758 | 12/1995 | Cunningham | 81/177.85 |

*Primary Examiner*—James G. Smith
*Assistant Examiner*—David B. Thomas

[57] ABSTRACT

A hand wrench is described for attachment with various sockets and other hand tool attachments to control the rotation of fasteners. The hand wrench has a main member with dimensions of length greater than width, and width greater than thickness such that it has a thin stamped form; and, a driving element fixed to and protruding out from the main member and formed to engage with sockets and other hand tool attachments. In some preferred embodiments, the main member is wider at one end and is bent offset with an obtuse angle of about 170 degrees. Because this hand wrench has a thin stamped form without a ratcheting mechanism, the present invention can access and engage fasteners under certain limited-access situations where a ratchet wrench (or any other known wrench) cannot. Additionally, the simple design and form allows the present invention to be manufactured at a much lower cost than a ratchet wrench or flex "T" handle, providing the consumer with an inexpensive alternative to a ratchet wrench or flex "T" handle.

20 Claims, 2 Drawing Sheets

WRENCH SOCKET LEVER (Continuation-in-part of U.S. Ser. No. 29/061,533 filed on Oct. 25, 1996 entitled SOCKET LEVER, now D396, 785.)

BACKGROUND OF THE INVENTION

Field of the Invention

The present invention relates to tools, particularly hand tools and most particularly those hand tools which act as a separable wrench lever or handle for wrench sockets and other tool attachments. Examples of such prior known hand tools are ratchet wrenches and flex "T" handle type wrenches.

A wrench socket by itself can not perform its function as a wrench without the attachment of a handle or lever to provide leverage to the socket. A ratchet type wrench is designed to attach to a socket and provide such leverage. However, a ratchet wrench can be relatively expensive with regards to the socket it turns because it has multiple components including a ratcheting mechanism. This ratcheting mechanism not only increases the cost of the wrench, but also increases the height and thickness of the wrench which can prohibit access and engagement of socket to fasteners under certain limited access situations. A flex "T" handle type wrench is also designed to attach to a socket to provide leverage, and like the ratchet wrench, the flex "T" handle can also be relatively expensive with regards to the socket it turns because it is designed as a long, high leverage tool requiring high strength components. This high strength requirement not only increases the cost of the wrench, but also increases the height and thickness of the wrench which again, can prohibit access and engagement of socket to fasteners under certain limited access situations.

SUMMARY OF THE INVENTION

The present invention is a hand wrench for attachment with various sockets and other hand tool attachments to control the rotation of fasteners. The present invention has a main member with dimensions of length greater than width, and width greater than thickness such that it has a thin stamped form; and, a driving element fixed to and protruding out from the main member and formed to engage with sockets and other hand tool attachments. In some preferred embodiments, the main member is wider at one end and is bent offset with an obtuse angle of about 170 degrees. Because the present invention has a thin stamped form without a ratcheting mechanism, a socket attached to the present invention can access and engage fasteners under certain limited-access situations where a socket attached to a ratchet wrench (or any other known wrench) cannot. Additionally, the simple design and form allows the present invention to be manufactured at a much lower cost than a ratchet wrench or flex "T" handle, providing the consumer with an inexpensive alternative to a ratchet wrench or flex "T" handle.

Accordingly, it is a primary objective of the present invention to have it cost significantly less to manufacture than a ratchet wrench or a flex "T" handle, to provide the consumer with an inexpensive alternative to a ratchet or flex "T" handle wrench.

Another important objective of the present invention is that the combined height of wrench and socket is significantly less than the combined height of a ratchet wrench and socket or a flex "T" handle and socket.

Another important object of the present invention is to provide a hand wrench that is commercially viable, simple in design, cost-efficient to manufacture, and durable under extended professional/industrial use.

BRIEF SUMMARY OF THE DRAWINGS

The present invention as described in this specification will be more fully understood when taken in conjunction with the drawings appended hereto, wherein.

DETAILED DESCRIPTION OF THE DRAWINGS

A wrench socket by itself can not perform its function as a wrench without the attachment of a handle or lever to provide leverage to the socket. A ratchet type wrench is designed to attach to a socket and provide such leverage. However, a ratchet wrench can be relatively expensive with regards to the socket it turns because it has multiple components including a ratcheting mechanism. This ratcheting mechanism not only increases the cost of the wrench, but it also increases the height and thickness of the wrench which can prohibit access and engagement of socket to fasteners under certain limited access situations. A flex "T" handle type wrench is also designed to attach to a socket to provide leverage and like the ratchet wrench, the flex "T" handle can also be relatively expensive with regards to the socket it turns because it is designed as a long, high leverage tool requiring high strength components. This high strength requirement not only increases the cost of the wrench, but also increases the height and thickness of the wrench which again, can prohibit access and engagement of socket to fasteners under certain limited access situations. Because the present invention has a thin stamped form without a ratcheting mechanism, a socket attached to the present invention can access and engage fasteners under certain limited-access situations where a socket attached to a ratchet wrench (or any other known wrench) cannot. Additionally, the simple design and form allows the present invention to be manufactured at a much lower cost than a ratchet wrench or flex "T" handle, providing the consumer or end user with an inexpensive alternative to a ratchet or flex "T" handle wrench.

Figure 1:
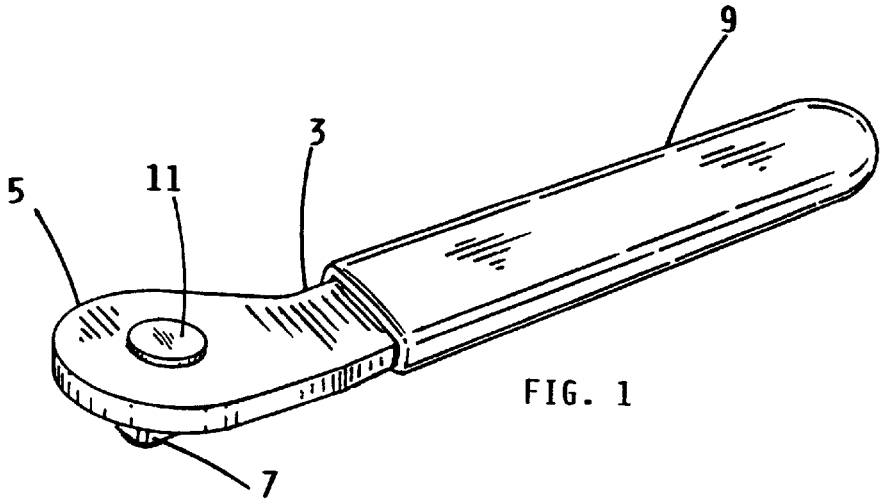
FIG. 1 is a perspective view of the present invention hand wrench.

Referring now to FIG. 1, there is shown a perspective view of a present invention hand wrench 3 with elongated main member 5 having vinyl grip 9, and driving element 7 with top 11. Main member 5 has dimensions of length greater than width and width greater than thickness such that main member 5 has a thin, stamped form and appearance. Driving element 7 is fixed to and protrudes out of main member 5, and has a shape formed for attachment with various sockets and hand tool attachments to control the rotation of fasteners.

Figure 2:
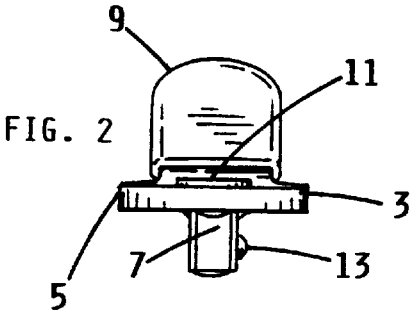
FIG. 2 is a front elevation view of the present invention hand wrench shown in FIG. 1; and, FIG. 3 is a back elevation view of the present invention hand wrench shown in FIGS. 1 and 2; and, FIG. 4 is a top plan view of the present invention hand wrench shown in FIGS. 1, 2, and 3; and, FIG. 5 is a bottom plan view of the present invention shown in FIGS. 1, 2, 3, and 4; and, FIG. 6 is a left side view of the present invention shown in FIGS. 1, 2, 3, 4, and 5; and, FIG. 7 is a right side view of the present invention shown in FIGS. 1, 2, 3, 4, 5, and 6; and, FIG. 8 is a right side view of another present invention hand wrench; and, FIG. 9 is a right side partial view of a ratchet wrench, with an attached cut socket controlling the rotation of a fastener; and, FIG. 10 is a right side partial view of a present invention hand wrench with an attached cut socket controlling the rotation of a fastener.

FIG. 2 is a front elevation view of the present invention hand wrench shown in FIG. 1 with hand wrench 3 having main member 5 with vinyl grip 9, driving element 7 with top 11 and spring loaded ball 13. Driving element 7 is fixed to and protrudes out of main member 5, and has a shape formed for attachment with various sockets and hand tool attachments to control the rotation of fasteners. Spring loaded ball 13 helps to temporarily secure the various sockets and hand tool attachments to driving element 7.

Figure 3:
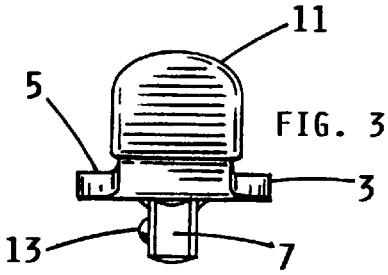

FIG. 3 is a back elevation view of the present invention hand wrench shown in FIGS. 1 and 2 with hand wrench 3 having main member 5 with vinyl grip 9, driving element 7 with top 11 and spring loaded ball 13. Driving element 7 is fixed to and protrudes out of main member 5, and has a shape formed for attachment with various sockets and hand tool attachments to control the rotation of fasteners. Spring loaded ball 13 helps to temporarily secure the various sockets and hand tool attachments to driving element 7.

Figure 4:
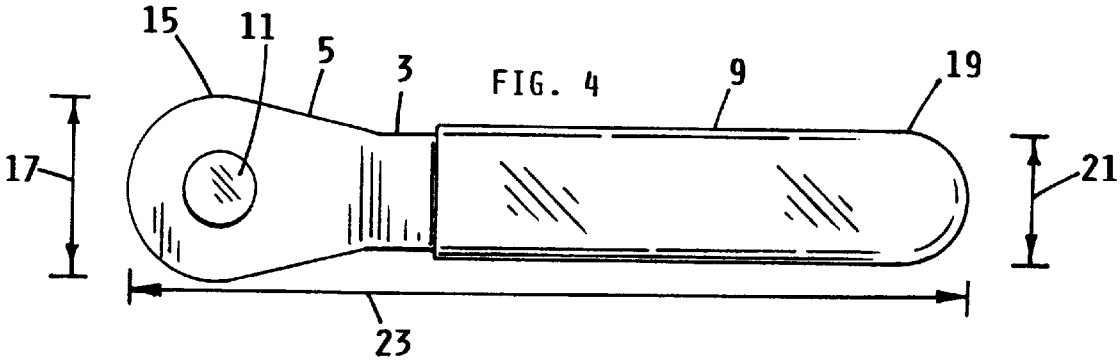

FIG. 4 is a top plan view of the present invention hand wrench shown in FIGS. 1, 2, and 3. Hand wrench 3 has elongated main member 5 having vinyl grip 9, and a driving element with top 11. Main member 5 has dimensions of length greater than width, and width greater than thickness such that main member 5 has a thin, stamped form and appearance. Dimension 23 represents the length of main member 5, and dimension 17 represents the width at the front part 15 of main member 5, and dimension 21 represents the width at the rear part 19 of main member 5. In this preferred embodiment, the front part 15 of main member 5 is wider than the rear part 19 to provide engineered strength to main member 5 where driving element 7 is fixed to and protrudes out of main member 5 for attachment with various sockets and hand tool attachments to control the rotation of fasteners. Preferred embodiments of the present invention each have a main member that is wider on one end than the other to keep the thickness dimension of main member 5 to a minimum.

Figure 5:
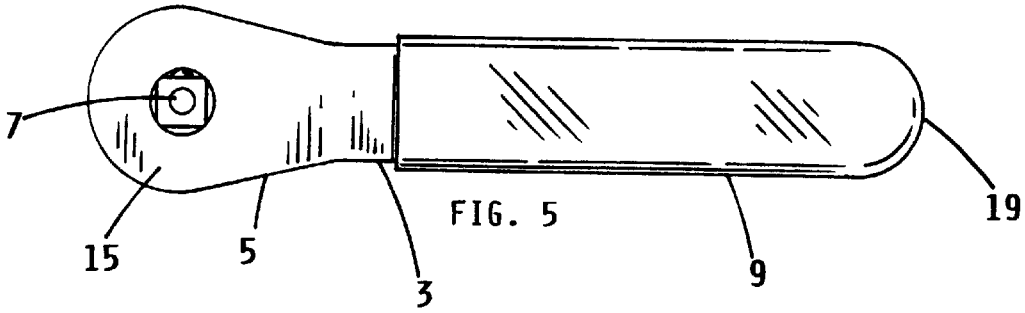

FIG. 5 is a bottom plan view of the present invention shown in FIGS. 1, 2, 3, and 4. Hand wrench 3 has elongated main member 5 having vinyl grip 9, and driving element 7. Main member 5 has dimensions of length greater than width, and width greater than thickness such that main member 5 has a thin, stamped form and appearance. In this view you can see that driving element 7 has a substantially square shape which is relative to the standardized, square shaped cavity of sockets and hand tool attachments. As described previously, the front part 15 of main member 5 is wider than the rear part 19 to provide engineered strength to main member 5 where driving element 7 is fixed to and protrudes out of main member 5 for attachment with various sockets and hand tool attachments to control the rotation of fasteners.

Figure 6:
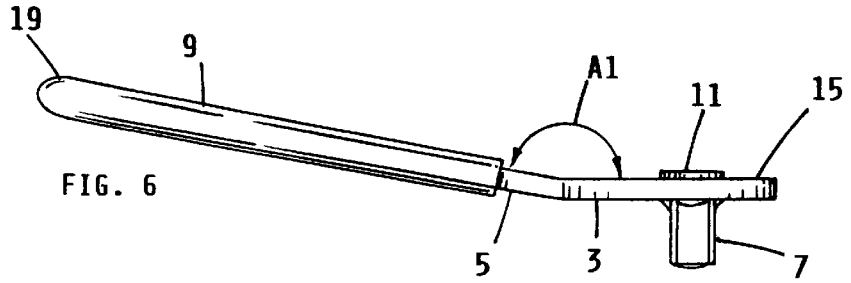

FIG. 6 is a left side view of the present invention shown in FIGS. 1, 2, 3, 4, and 5. Hand wrench 3 has main member 5 with vinyl grip 9. Fixed to and protruding out of main member 5 is driving element 7 with top 11. From this view it is visible that main member 5 is bent offset to provide clearance for the hand of a user and provide additional access to wrench 3 under certain limited access situations. The angle at which main member 5 is bent offset is represented by A1 which is about 170 degrees in this embodiment. Main member 5 can be bent offset at almost any angle, however, preferred embodiments are generally bent offset with an obtuse angle between the ranges of 165 degrees and 175 degrees. The most preferred embodiments of the present invention have main members which are bent offset with an obtuse angle of about 170 degrees.

Figure 7:
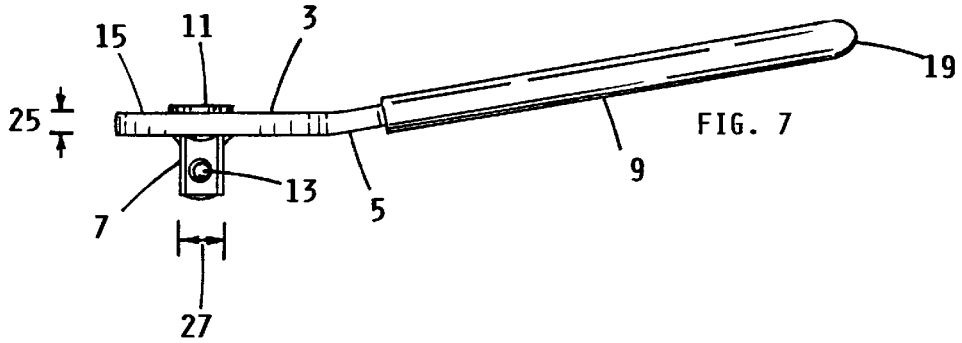

FIG. 7 is a right side view of the present invention shown in FIGS. 1, 2, 3, 4, 5, and 6 with the same components numbered respectively. In addition spring loaded ball 13 of driving element 7 can be seen in this view. In all embodiments of the present invention there is a main member 5 that has a thin stamped form with dimensions of length greater than width and width greater than thickness. There is also a driving element 7 which is fixed to and protruding out of main member 5. Driving element 7 has a substantially square shape formed to engage with various sockets and hand tool attachments. Also, in every case there is a relationship between the width dimension of driving element 7 and the thickness dimension 25 of main member 5, whereas the thickness dimension of main member 5 is always equal to or less than ¾ the width dimension of driving element 7. In this figure, driving element 7 has a width dimension of about ¼ inch, and the thickness dimension of main member 5 is about ⅛ inch or approximately ½ the width dimension of driving element 7. When considering this relationship which limits the thickness of hand wrench 3, main member 5 can be manufactured a variety of ways including a simple stamping process for shorter wrenches as shown here, and a metal treated or forging process for longer versions. If main member 5 is too thin, it would not have the strength necessary for a wrench, and if main member 5 is too thick, it would preclude access to fasteners under certain limited access situations and increase manufacturing material costs. With one of the objectives being to keep manufacturing costs down relative to ratchets and flex "T" handles, a relatively short main member similar to that shown in these figures could be manufactured with a stamping process keeping forging and treating costs down. Of course longer versions may require treating and or forging which would increase manufacturing costs.

Figure 8:
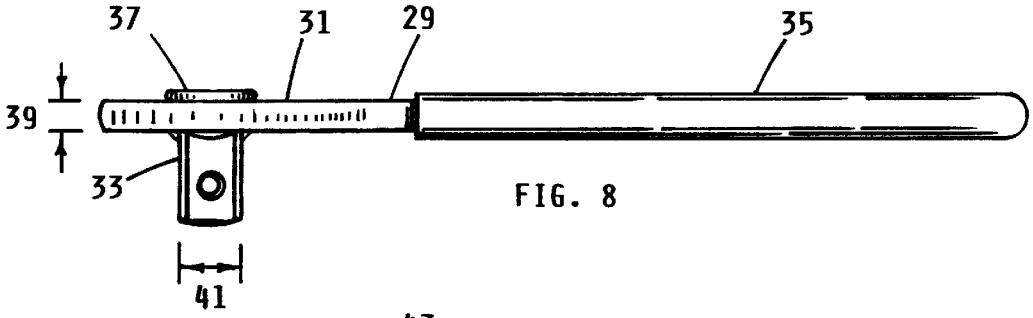

FIG. 8 is a right side view of another present invention hand wrench 29 with main member 31, driving element 33 with top 37, and vinyl grip 35. Main member 31 that has a thin stamped form with dimensions of length greater than width and width greater than thickness. In this embodiment, main member 31 is not bent offset. The present invention may or may not be bent offset depending upon its general or specific intended applications. There is also driving element 33 fixed to and protruding out main member 31. Driving element 33 has a substantially square shape formed to engage with various sockets and hand tool attachments. Again, in all embodiments of the present invention, there is a relationship between the width dimension of driving element 33 and the thickness dimension 39 of main member 31, whereas the thickness dimension 39 of main member 31 is always equal to or less than ¾ the width dimension 41 of driving element 33. In this figure driving element 33 has a width dimension 41 of about ⅜ inch, and the thickness dimension 39 of main member 31 is about 3/16 inch or approximately ½ the width dimension of driving element 33. When considering this relationship which limits the thickness of hand wrench 29, main member 31 can be manufactured a variety of ways including a simple stamping process for shorter wrenches as shown here, and a metal treated or forging process for longer versions.

Figure 9:
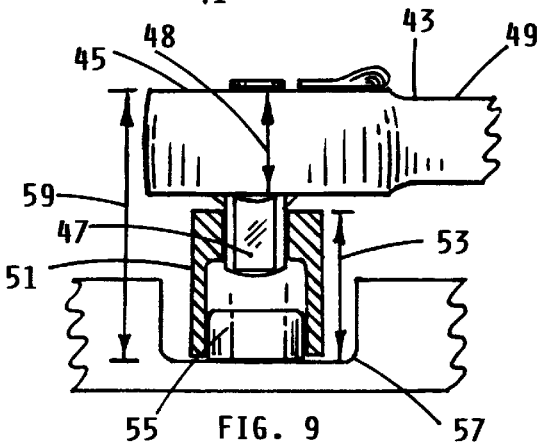

FIG. 9 shows a typical, prior art ratchet wrench 43 with attached cut socket 51 engaging and turning fastener 55 in recess 57. In this figure, recess 57 is too deep for a box or open-end type wrench to engage with fastener 55 to control the rotation thereof, because the handle of each type wrench would hit the top corners of the recess preventing the head of each type wrench from fully engaging with fastener 55. This is one of several limited access situations where only a socket is deep enough to engage with fastener 55, and other known type wrenches will not work. Under these situations, the height clearance required for the wrench with attached socket becomes a factor. Occasionally, there is an obstruction over the fastener and the combined height of a ratchet and socket, or flex "T" handle and socket is too high, preventing the socket attached to such wrenches from accessing and engaging with the fastener. In these situations, the present invention with its reduced height will often work.

In this FIG. 9, prior art ratchet wrench 43 has head 45, driving element 47 and handle 49. Ratchet head 45 has thickness dimension 48 which is much thicker than the present invention because ratchet head 45 has a ratcheting mechanism which requires a much thicker head than the present invention. The combined access height shown by dimension 59 is equal to the thickness dimension 48 of ratchet head 45 plus the height dimension 53 of socket 51.

Figure 10:
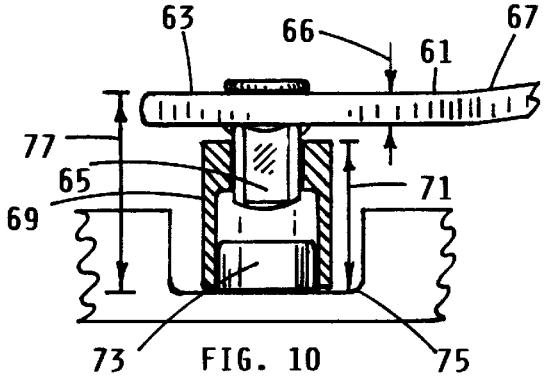

FIG. 10 shows hand wrench 61 with attached cut socket 69 engaging and turning fastener 73 in recess 75. In this figure, recess 75 is too deep for a open-end type wrench to engage with fastener 73 to control the rotation thereof, because the handle of each type wrench would hit the top corners of the recess preventing the head of each type wrench from fully engaging with fastener 73. This is one of several limited access situations where only a socket is deep enough to engage with fastener 73, and other known type wrenches will not work. Under these situations, the height clearance required for the wrench with attached socket becomes a factor. Occasionally, there is an obstruction over the fastener and the combined height of a ratchet and socket, or flex "T" handle and socket is too high, preventing the socket attached to such wrenches from accessing and engaging with the fastener. In these situations, the present invention with its reduced height will often work.

In this FIG. 10, the present invention hand wrench 61 has head 63, driving element 65 and handle 67. Wrench head 63 has a thin, stamped form with a thickness dimension 66 which is much less than that of a ratchet wrench because the present invention does not have a ratcheting mechanism. Additionally, thickness dimension 66 is much less than that of a flex "T" handle because the present invention does not have a thick forged body or main member which a "T" handle wrench requires to give it adequate strength. The combined access height shown by dimension 77 is equal to the thickness dimension 66 of wrench head 63 plus the height dimension 71 of socket 69.

With the height dimension 71 of socket 69 the same as the height dimension 53 of socket 51 in FIG. 9, it is easy to see than the combined access height 77 of the present invention wrench 61 with socket 69 in FIG. 10, is significantly less than the combined access height 59 of ratchet wrench 43 with socket 51 in FIG. 9.

Having thus described the invention, what is claimed as new and desired to be secured by Letters Patent:

1. A hand wrench for attachment with various sockets and other hand tool attachments to control the rotation of fasteners, said hand wrench comprising:

a. a main member having a thin stamped form and dimensions of length greater than width, and width greater than thickness; and, b. a driving element fixed to and protruding out from said main member and having a substantially square shape formed for attachment with various sockets and hand tool attachments, said driving element having dimensions of width relative to the thickness dimension of said main member whereas the maximum thickness dimension of said main member at any area the entire length thereof is equal to or less than ¾ the width dimension of said driving element.

2. A hand wrench of claim 1, wherein the main member is bent offset with an obtuse angle equal to or less than 175 degrees.

3. A hand wrench of claim 1, wherein the main member is bent offset with an obtuse angle between the ranges of 165 degrees and 175 degrees.

4. A hand wrench of claim 1, wherein the main member is bent offset with an obtuse angle of about 170 degrees.

5. A hand wrench of claim 1, wherein the width dimension of said driving element is about ¼ inch.

6. A hand wrench of claim 1, wherein the width dimension of said driving element is about ⅜ inch.

7. A hand wrench of claim 1, wherein the width dimension of said driving element is about ½ inch.

8. A hand wrench of claim 3, wherein the width dimension of said driving element is about ¼ inch.

9. A hand wrench of claim 3, wherein the width dimension of said driving element is about ⅜ inch.

10. A hand wrench of claim 3, wherein the width dimension of said driving element is about ½ inch.

11. A hand wrench for attachment with various sockets and other hand tool attachments to control the rotation of fasteners, said hand wrench comprising;

a. a main member having a thin stamped form and dimensions of length greater than width, and width greater than thickness, said main member being wider on one end; and, b. a driving element fixed to and protruding out from the wider end of said main member and having a substantially square shape formed for attachment with various sockets and hand tool attachments, said driving element having dimensions of width relative to the thickness dimension of said main member whereas the maximum thickness dimension of said main member at any area the entire length thereof is equal to or less than ¾ the width dimension of said driving element.

12. A hand wrench of claim 11, wherein the main member is bent offset with an obtuse angle equal to or less than 175 degrees.

13. A hand wrench of claim 11, wherein the main member is bent offset with an obtuse angle between the ranges of 165 degrees and 175 degrees.

14. A hand wrench of claim 11, wherein the main member is bent offset with an obtuse angle of about 170 degrees.

15. A hand wrench of claim 11, wherein the width dimension of said driving element is about ¼ inch.

16. A hand wrench of claim 11, wherein the width dimension of said driving element is about ⅜ inch.

17. A hand wrench of claim 11, wherein the width dimension of said driving element is about ½ inch.

18. A hand wrench of claim 13, wherein the width dimension of said driving element is about ¼ inch.

19. A hand wrench of claim 13, wherein the width dimension of said driving element is about ⅜ inch.

20. A hand wrench of claim 13, wherein the width dimension of said driving element is about ½ inch.

* * * * *